US010791818B1

(12) United States Patent
Anguiano

(10) Patent No.: US 10,791,818 B1
(45) Date of Patent: Oct. 6, 2020

(54) HAIR EXTENSION SUPPORT APPARATUS

(71) Applicant: Bridgette Anguiano, San Francisco, CA (US)

(72) Inventor: Bridgette Anguiano, San Francisco, CA (US)

( * ) Notice: Subject to any disclaimer, the term of this patent is extended or adjusted under 35 U.S.C. 154(b) by 577 days.

(21) Appl. No.: 15/410,162

(22) Filed: Jan. 19, 2017

Related U.S. Application Data

(60) Provisional application No. 62/280,540, filed on Jan. 19, 2016.

(51) Int. Cl.
*A45D 44/14* (2006.01)

(52) U.S. Cl.
CPC ..... *A45D 44/14* (2013.01)

(58) Field of Classification Search
CPC ..... A45D 44/14; A47F 7/06; A47F 7/065
USPC ..... 223/66, 84, 120
See application file for complete search history.

(56) References Cited

U.S. PATENT DOCUMENTS 933,282 A 9/1909 Woodruff et al.
3,101,557 A * 8/1963 Watlington ..... A45D 44/14 223/66
3,132,778 A * 5/1964 Leclabart ..... A45D 44/14 223/66
3,198,408 A * 8/1965 Benner ..... A47F 7/065 132/53
3,447,726 A * 6/1969 George ..... A45D 44/14 132/54
3,726,022 A * 4/1973 Helwig ..... A45D 20/00 223/66
4,370,137 A * 1/1983 Herzig ..... A45D 44/005 434/94
5,252,074 A * 10/1993 Passage ..... G09B 1/08 434/94
D375,580 S * 11/1996 Giedd ..... D19/103
D395,182 S * 6/1998 Singleton ..... D28/73
5,819,960 A * 10/1998 Bonazza ..... A47F 3/142 211/133.1
5,915,605 A * 6/1999 Blanchard ..... A47G 25/485 223/91
5,934,490 A * 8/1999 Mora ..... B25H 1/0007 212/176
6,554,235 B1 * 4/2003 Fortier ..... A47B 57/565 248/122.1
6,581,890 B2 6/2003 Johnson
7,159,728 B2 1/2007 Smith
8,998,002 B1 * 4/2015 Milner ..... A47F 7/065 211/13.1

(Continued)

FOREIGN PATENT DOCUMENTS

WO WO-2015089225 A1 * 6/2015 ..... A45D 44/14

*Primary Examiner* — Nathan E Durham
(74) *Attorney, Agent, or Firm* — Law Office of Sam Sokhansanj PLLC

(57) ABSTRACT

A hair extension and wig support apparatus is disclosed that allows a single user to use both hands to easily, efficiently, and accurately cut, style, or color multiple hair extension pieces and wigs. In particular, the hair extension support apparatus includes a head with a magnetic front facial region and a back region having one or more elastic straps for holding one or more hair extensions for cutting, styling, and coloring. The hair extension support apparatus also includes a detachable tray that can slide along a neck region of the support apparatus for supporting the hair extensions or other objects.

14 Claims, 10 Drawing Sheets

(56) References Cited

U.S. PATENT DOCUMENTS

| | | | | |
|---|---|---|---|---|
| 9,883,742 | B2 * | 2/2018 | Yang | A47K 1/09 |
| 10,393,163 | B2 * | 8/2019 | Ucgun | A63B 3/00 |
| 2006/0180558 | A1 * | 8/2006 | Engberg | F41B 5/14 211/60.1 |
| 2009/0008347 | A1 * | 1/2009 | Bell | A45D 44/02 211/61 |
| 2009/0120974 | A1 * | 5/2009 | Rossaki | A47G 25/20 223/94 |
| 2009/0275001 | A1 * | 11/2009 | Kubo | A45D 44/14 434/94 |
| 2015/0283471 | A1 | 10/2015 | Bergemann | |

* cited by examiner

HAIR EXTENSION SUPPORT APPARATUS

CROSS REFERENCE TO RELATED APPLICATION

This application claims the benefit of U.S. Provisional Application No. 62/280,540 filed on Jan. 19, 2016, which is incorporated herein by reference in its entirety

BACKGROUND

This section is intended to introduce the reader to aspects of art that may be related to various aspects of the present disclosure described herein, which are described and/or claimed below. This discussion is believed to be helpful in providing the reader with background information to facilitate a better understanding of the various aspects of the present disclosure described herein. Accordingly, it should be understood that these statements are to be read in this light, and not as admissions of prior art.

Hair extensions are commonly employed to effectively thicken or lengthen a person's natural hair. Hair extensions are typically provided in the form of a hair weft, in which single hair strands of natural hair or synthetic hair are connected to along a narrow strip-like base, strip, clip, or seam that can temporarily or permanently be secured to the hair or scalp of a person using a number of different methods.

Conventional methods of hair styling, such as cutting, coloring, curling, or straightening any type of hair extensions or wigs, constrain a user in to using only one hand for accomplishing the desired style, while the other hand is generally used for trying to keep the strands steady for styling. This method of styling hair extensions and wigs can cause significant fatigue in the arms of the user because of the level effort and exertion required by the user to maintain the hair at eye level or in a stabile steady orientation. As a result, at least two people are required to cut and color hair extensions or wigs, wherein one person holds the hair by the weft in a steady stationary orientation, allowing the second person to use both hands, with one grasping and maneuvering the hair strands and the other hand operating a styling tool, such as a curling iron, flat iron, coloring chemicals, or scissors, among others. In addition, most professional hair stylists do not offer hair extension coloring because it is much too difficult to achieve the desired result without having the hair attached to a person's head and hair. Further, even if the hair extension is attached to the person's hair and then colored, then the person's own natural hair would then be subjected to unwanted color, or uneven color around the area where of the hair where the extension is attached.

In addition, the shape of hair is determined by the structure of the polymers of the hair, and that this structure can be loosened using thermal application, which makes the hair subjectable to a new style. It is essential for the hair to cool and reach room temperature while maintaining the desired style shape in order for the polymers to restructure and bond correctly. As such, while the air cools the polymers restructure to the new style diminishing the need for use of chemical products such as hairspray. In the conventional method of hair styling and curling hair, the hair extensions or wigs fall with gravity once the thermal tool (i.e. curling iron) is removed from the hair. Such a method is ineffective to achieve the desired style because the hair expands and extends, losing the initial curling shape before it reaches original cooled temperature.

Therefore, what is needed is a support apparatus that allows a user to easily and accurately cut, color, or style multiple hair extensions in an efficient and quick manner.

BRIEF SUMMARY

In one aspect of the disclosure described herein, a hair extension and wig support apparatus is disclosed that allows a single user to use both hands to easily, efficiently, and accurately cut, style, or color multiple hair extension pieces and wigs, among other advantages.

In another aspect of the disclosure described herein, a hair extension support apparatus is disclosed having a head comprising a front region and a back region, an elongated neck, one or more elastic straps secured the back region of the head, and a tray coupled to the elongated neck, wherein the tray is configured to slide relative to the neck. In addition, the elastic straps can be configured or adapted to support one or more hair extensions or hair wefts. Further, the front region of the head can include one or magnetic elements. In addition, the elastic strap can be either a single band or a dual bi-furcated band. Also, the elastic can include a plurality or apertures or perforations. Further, the tray can magnetically be coupled to the elongated neck. Here, the elongated neck can include a channel or a pair of tracks, wherein the tray is coupled to the channel or the pair of tracks. Further, the base can include one or more suction cups.

In another aspect of the disclosure described herein, a hair extension support apparatus is disclosed having a head, neck, base, a plurality of securement devices secured the head and adapted to secure one or more hair extensions or hair wefts, and a tray coupled to the neck, wherein the tray is configured to slide relative to the neck. Further, the securement devices are can include one or more of a dual strap, perforated straps, elastic bands, dual elastic bands, flexible straps, wires, hooks, magnets, fasteners, or adhesives. In addition, tray may be magnetized or include a magnetic element. Here, the neck can include a channel extending along the neck, and the tray can include an elongated tab, wherein the elongated tab can be configured to engage the channel.

In another aspect of the disclosure described herein, a hair extension support apparatus is disclosed having a head, an elongated middle region having a curvature, a plurality of elastic bands secured the head at least partially extending around a back region of the head, and a tray coupled to the elongated middle region, wherein the tray is configured to slide along the curvature of the elongated middle region.

The above summary is not intended to describe each and every disclosed embodiment or every implementation of the disclosure. The Description that follows more particularly exemplifies the various illustrative embodiments.

BRIEF DESCRIPTION OF THE DRAWINGS

The following description should be read with reference to the drawings, in which like elements in different drawings are numbered in like fashion. The drawings, which are not necessarily to scale, depict selected embodiments and are not intended to limit the scope of the disclosure. The disclosure may be more completely understood in consideration of the following detailed description of various embodiments in connection with the accompanying drawings, in which.

DETAILED DESCRIPTION

In the Brief Summary of the present disclosure above and in the Detailed Description of the disclosure described herein, and the claims below, and in the accompanying drawings, reference is made to particular features (including method steps) of the disclosure described herein. It is to be understood that the disclosure of the disclosure described herein in this specification includes all possible combinations of such particular features. For example, where a particular feature is disclosed in the context of a particular aspect or embodiment of the disclosure described herein, or a particular claim, that feature can also be used, to the extent possible, in combination with and/or in the context of other particular aspects and embodiments of the disclosure described herein, and in the disclosure described herein generally.

The embodiments set forth below represent the necessary information to enable those skilled in the art to practice the disclosure described herein and illustrate the best mode of practicing the disclosure described herein. In addition, the disclosure described herein does not require that all the advantageous features and all the advantages need to be incorporated into every embodiment of the disclosure described herein.

Figure 1:
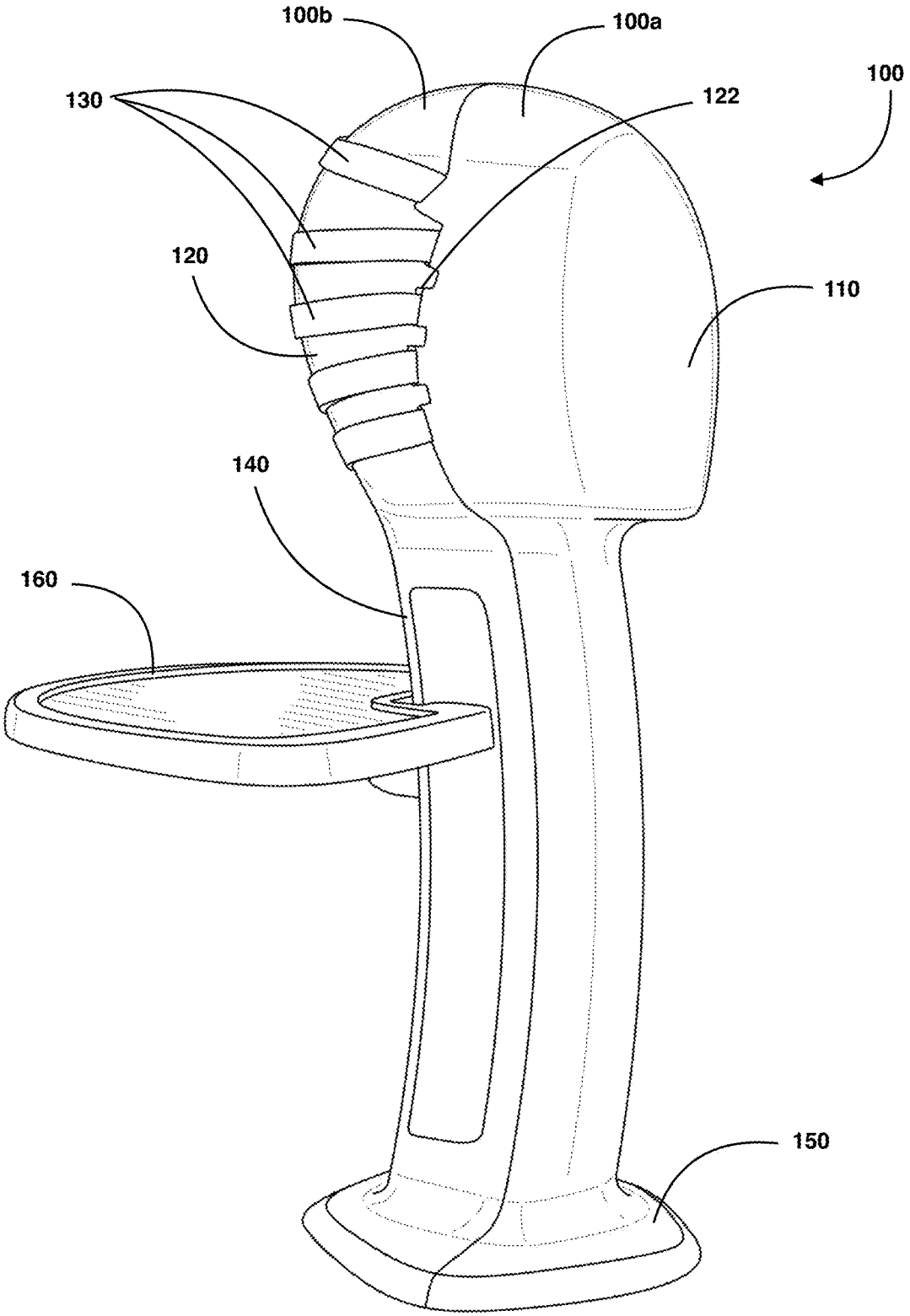
FIG. 1 illustrates a perspective front view for one non-limiting embodiment of the hair extension support apparatus of the disclosure described herein.

FIG. 1 illustrates one embodiment for the hair extension support apparatus of the disclosure described herein. Here, the hair extension support apparatus 100 is shown comprised of two half pieces 100*a* and 100*b* secured to each other, wherein apparatus 100 generally simulates a human head and neck, and may also be dimensioned to various male or female average head and neck sizes. Alternatively, apparatus 100 may also have any configuration that does not resemble a simulated human head or neck. Referring to FIG. 1, piece 100*a* can include the front facial area 110 which can be magnetized to hold and support one or more metal objects or accessories. In addition, piece 100*a* can further include a portion of the neck region 140 and the base region 150 of the support apparatus. Piece 100*b* can include the back head region 120 for supporting and securing a plurality of elastic hair extension support straps or bands 130, wherein each of bands 130 encircles piece 100*b* and is further secured within notches 122 of back head portion 120 to prevent slippage. In the alternative, other securement mechanisms may be used in lieu of bands 130, including but not limited to wires, meshed screen, ribbon, rope, string, clips, snaps, adhesives, or hooks, among others. In addition, support apparatus 100 further include a detachable cooling tray 160 that can couple to neck region 100, wherein tray 160 can be adapted to support the lower end regions of one or more curled or styled hair extensions, in order to help preserve their shape while cooling, among other purposes. Further, apparatus 100 and the positions of bands 130 can also demonstrate a simulation for how hair extensions will look when attached to an actual person's head.

Figure 2:
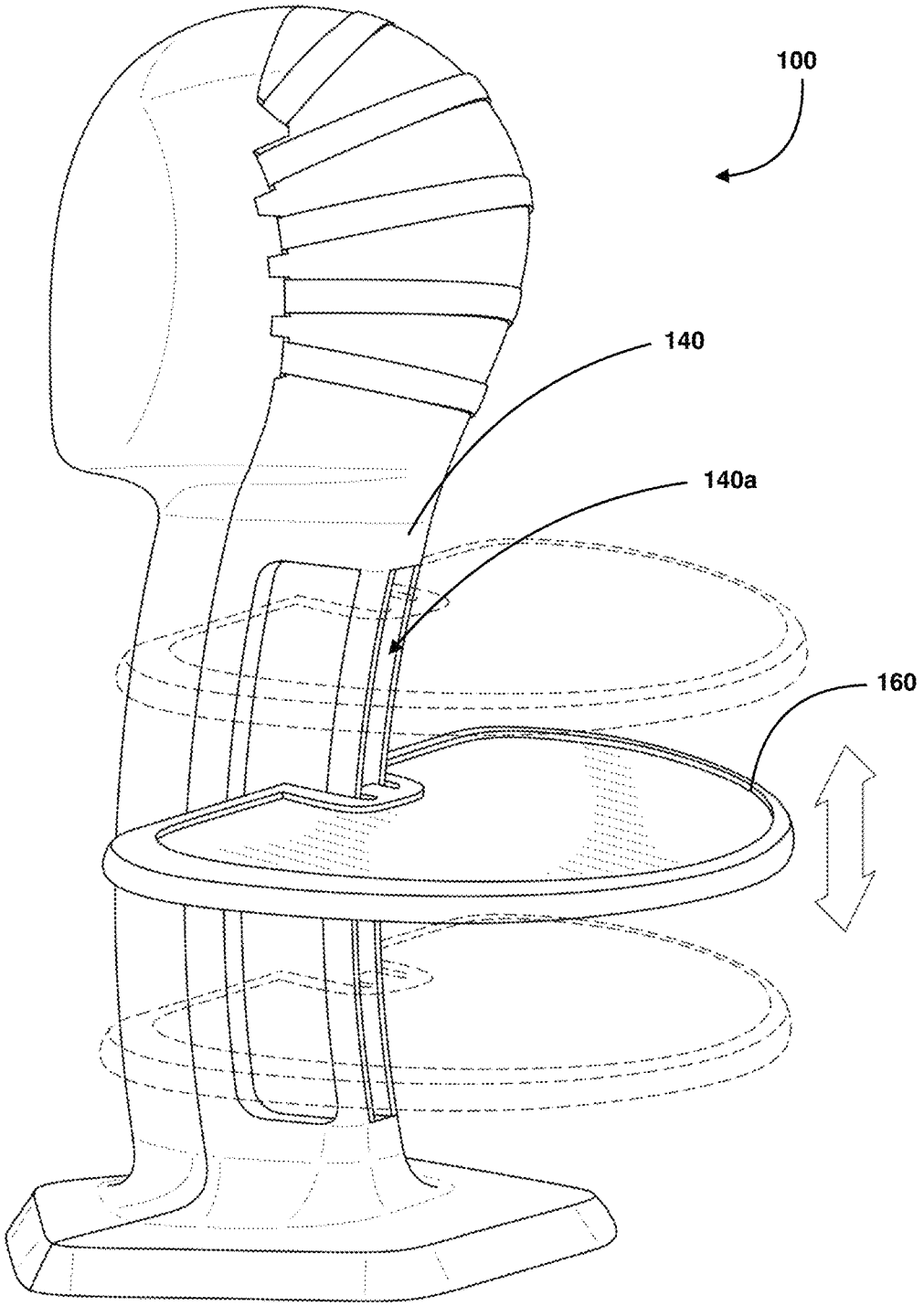
FIG. 2 illustrates a perspective rear view for one non-limiting embodiment of the hair extension support apparatus of the disclosure described herein.

FIG. 2 illustrates one method of operating tray 160, wherein tray 160 can be adapted to slide along a groove, rail, channel, or track 140*a* within neck region 140 of the support apparatus. Here, tray 160 can be configured at any vertical height depending on the length of the hair extension strands or wig being supported.

Figure 3:
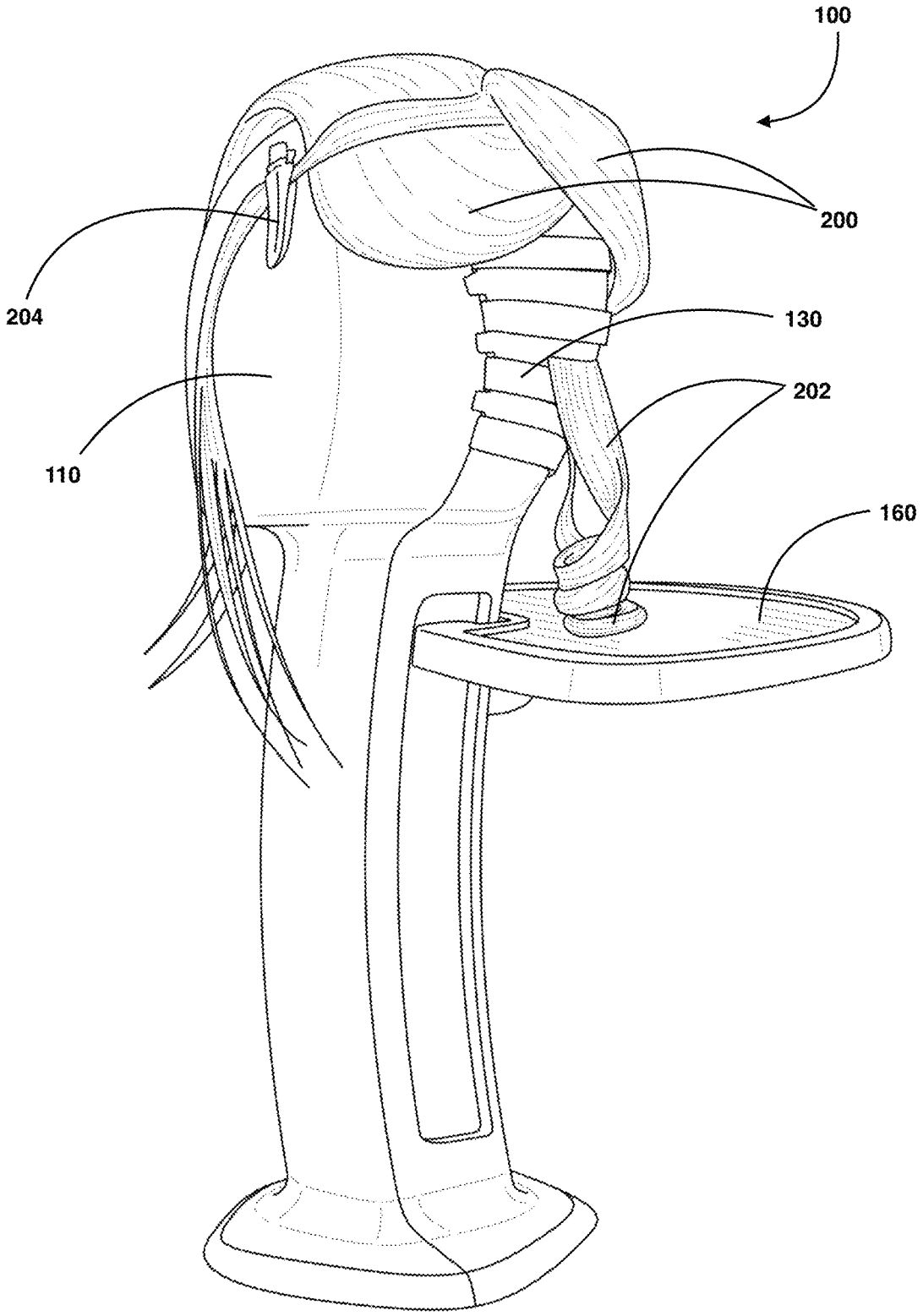
FIG. 3 illustrates a perspective front view for one non-limiting embodiment of the hair extension support apparatus of the disclosure described herein, shown with multiple hair extensions pieces attached to the apparatus.

FIG. 3 illustrates one method of using the hair extension support apparatus 100. Here, support apparatus 100 is shown with a plurality of hair extension pieces 200 and 202 secured to and held by elastic bands 130. In one embodiment, each band 130, or bands 130*a*-130*e* shown in FIGS. 4-6D, can be configured to hold anywhere from 5 to 200 clips, strands, or pieces of hair extensions. Still referring to FIG. 3, here tray 160 is shown supporting the ends of hair extension strands or pieces 202, thereby preserving the curled style (after having been curled via a heating element or curling iron) in a steady state orientation while the curled hair extension pieces cool and maintains their curled shape. In the alternative, tray 160 may also be used to support one or more cutting, styling, or coloring tools, including but not limited to scissors, brushes, combs, blow dryer, flat iron, or curling iron, among others.

Still referring to FIG. 3, face region 110 can also be magnetized or having magnetic elements to support one or more accessories or tools. Here, face region 110 is shown with a metal clip 204 coupled thereto, wherein clip 204 can help pull back or hold certain hair extensions or strands during styling, cutting, or coloring. In the alternative, clip 204, or one or more clips, may also be adapted to hold one or more eyelash extensions or strips, to further allow drying of an eyelash adhesive, and to also allow a user to style or curl eyelash extensions as well.

Figure 4:
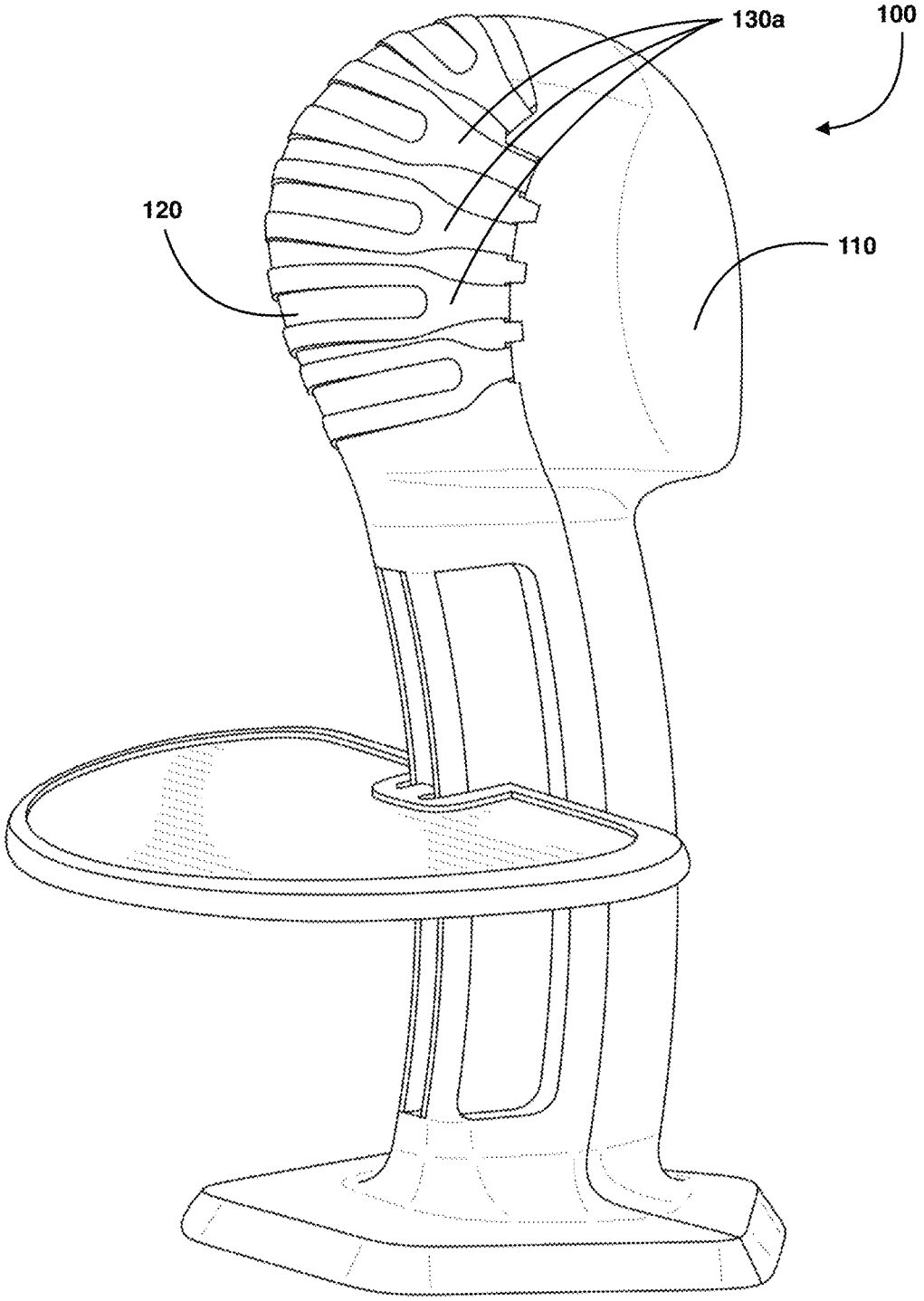
FIG. 4 illustrates a perspective rear view for one non-limiting embodiment of the hair extension support apparatus of the disclosure described herein, shown with alternative elastic hair bands.
Figure 5:
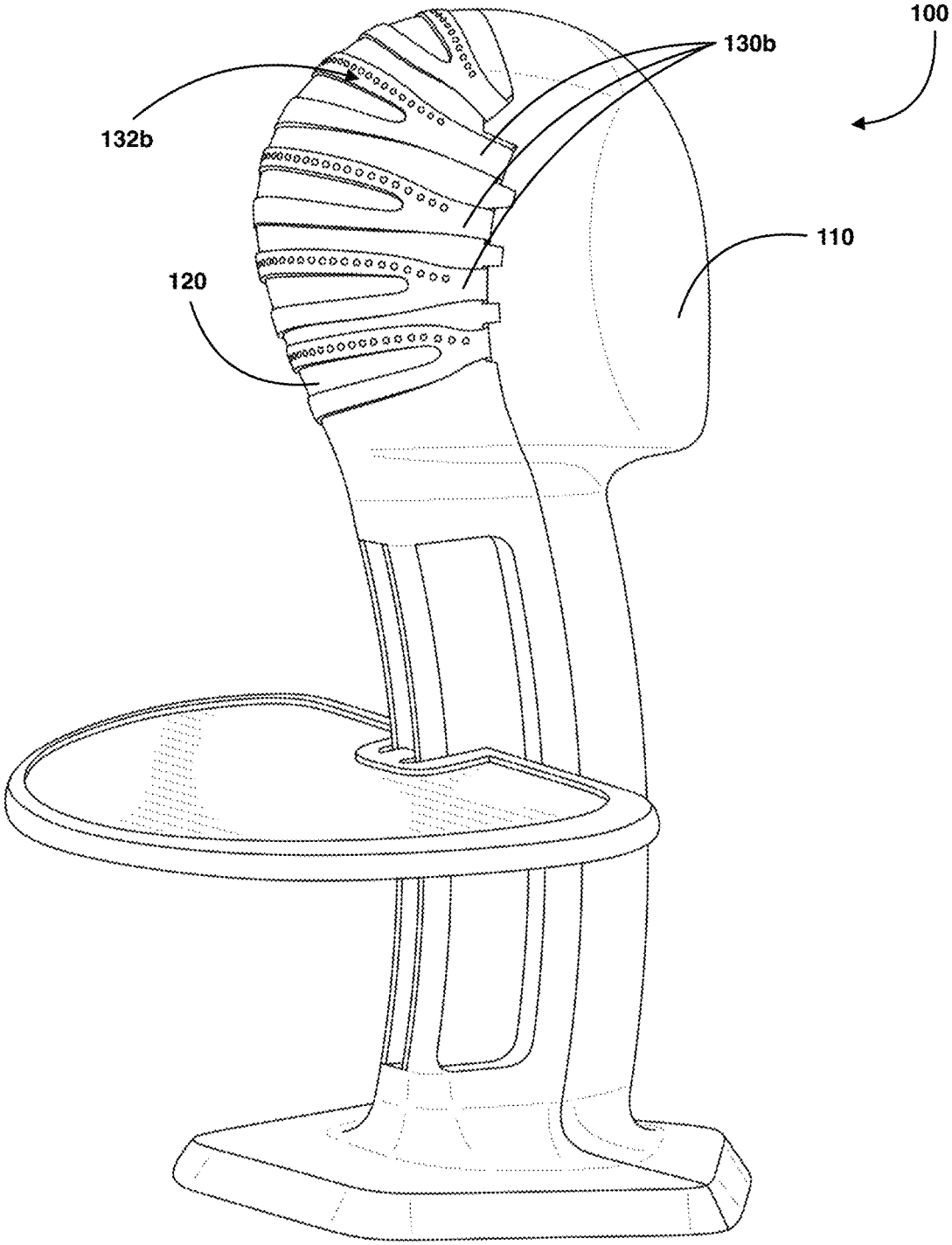
FIG. 5 illustrates a perspective rear view for one non-limiting embodiment of the hair extension support apparatus of the disclosure described herein, shown with alternative elastic hair bands having perforations.
Figure 6A:
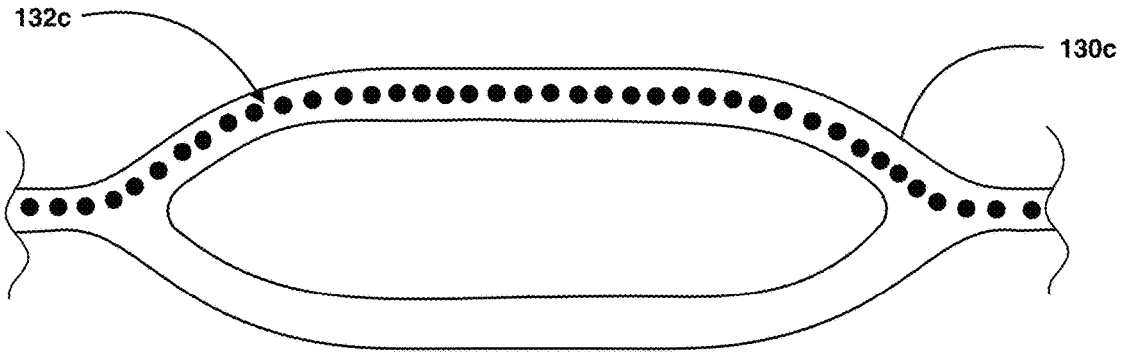
FIG. 6A illustrates a partial front view for one non-limiting embodiment of a hair band of the hair extension support apparatus of the disclosure described herein.
Figure 6B:
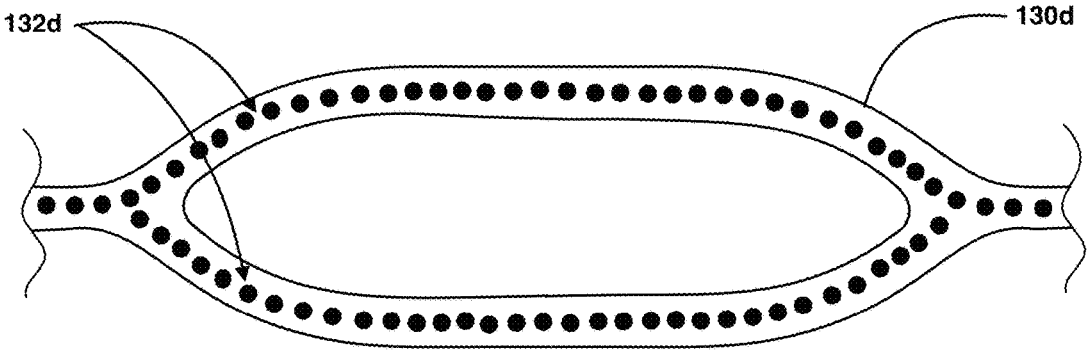
FIG. 6B illustrates a partial cut-away front view for another non-limiting embodiment of a hair extension elastic band of the hair extension support apparatus of the disclosure described herein.
Figure 6C:
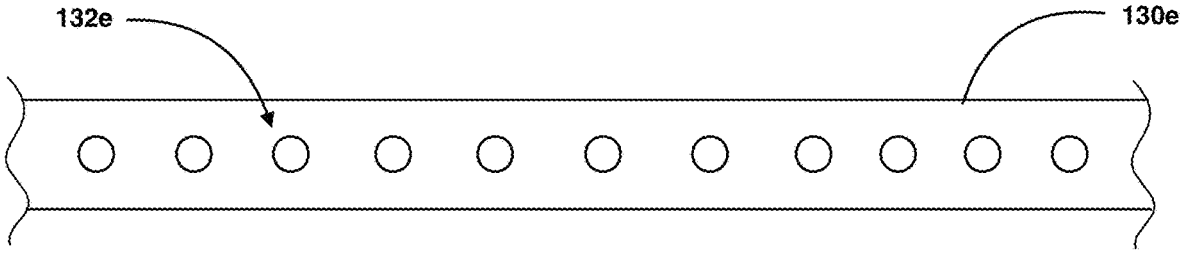
FIG. 6C illustrates a partial cut-away front view for another non-limiting embodiment of a hair extension elastic band of the hair extension support apparatus of the disclosure described herein.
Figure 6D:
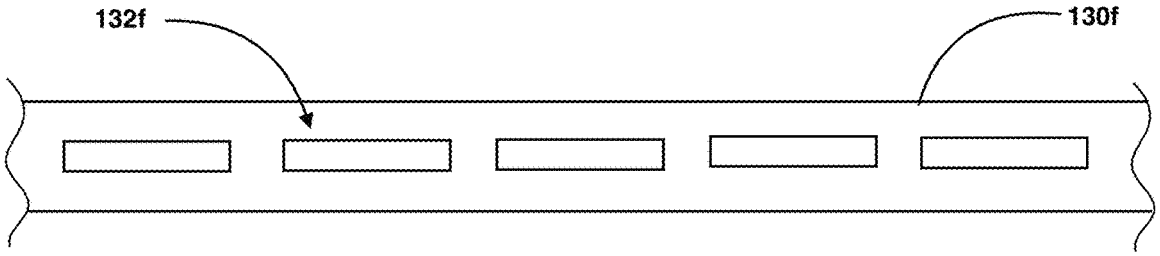
FIG. 6D illustrates a partial cut-away front view for another non-limiting embodiment of a hair extension elastic band of the hair extension support apparatus of the disclosure described herein.

FIGS. 4-6D illustrates alternative elastic bands to be used with the hair extension support apparatus 100. For example, FIG. 4 illustrates one configuration of elastic bands 130*a* having dual or bifurcated bands integrated therewith, wherein each of the dual bands can further support additional hair extensions, clips, or strands, thereby doubling the holding capacity of the support apparatus 100. FIG. 5 illustrates another configuration of elastic bands 130*b* having modified dual or bifurcated bands integrated therewith, wherein a top region of the dual band can have a plurality of apertures or perforations 132*b* to allow one or more hair extension strands or clips to be attached to the perforations of the elastic band. FIG. 6A illustrates another configuration for elastic band 130*c* having at least 40 perforations or apertures extending along the sides and top region of the dual band. FIG. 6B illustrates another configuration for elastic band 130*d* having anywhere from 40-100 perforations or apertures 132*d* extending along the sides, top region, and lower region of the dual band 130*d*. FIG. 6C illustrates another configuration for an elastic band 130*e* having a plurality of circular perforations or apertures 132*e* extending along the elastic band. FIG. 6D illustrates another configuration for an elastic band 130*f* having a plurality of slots 132*f* extending along the elastic band.

Figure 7A:
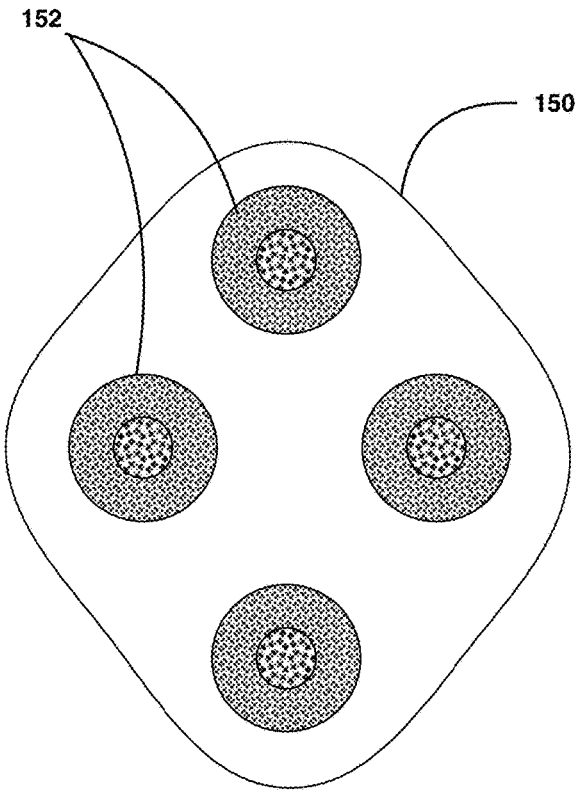
FIG. 7A illustrates a bottom view for one non-limiting embodiment of a base for the hair extension support apparatus of the disclosure described herein.

FIG. 7A illustrates a bottom view of the base 150 of support apparatus 100. Here, base 150 can be configured with a plurality of suction cups 152 fixed or secured to the bottom of base 150, thereby allowing base 150 to be securely held in place on any type of surface and prevent it from inadvertently tipping over. However, it is contemplated within the scope of the disclosure described herein that base 150 may also be secured to any type of surface via other securement mechanism, including but not limited to the base 150 being heavily weighted or made of steel, or secured to a surface via brackets, clips, magnets, adhesives, or any other type of fastener. In the alternatively, apparatus 100 may also be suspended from a wall via one or more articulating extension arms, brackets, cables, or hooks.

Figure 7B:
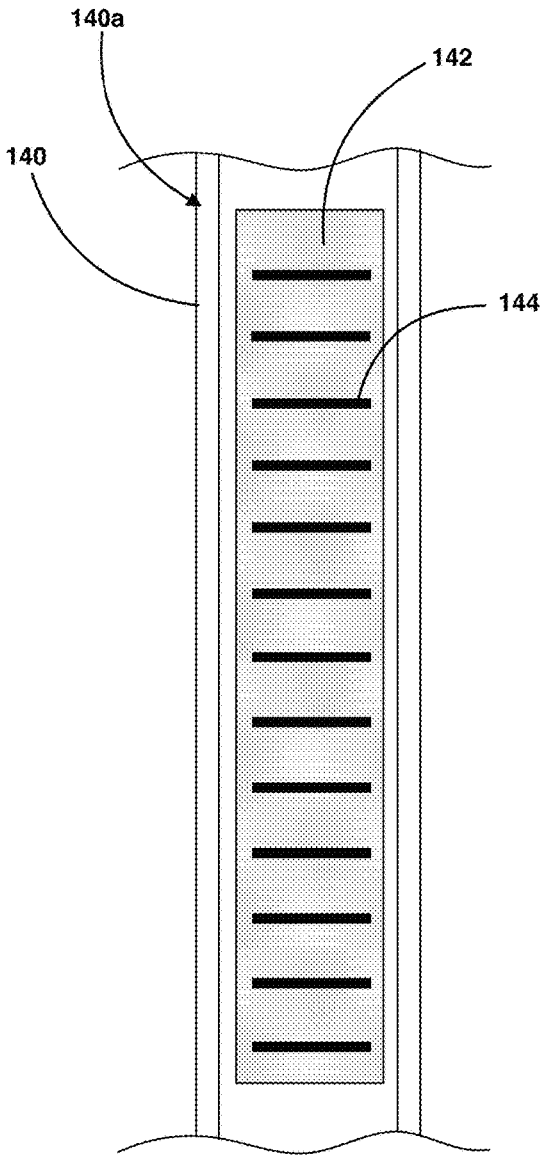
FIG. 7B illustrates a partial cut-away cross sectional rear view of a neck of the hair extension support apparatus of the disclosure described herein.
Figure 8A:
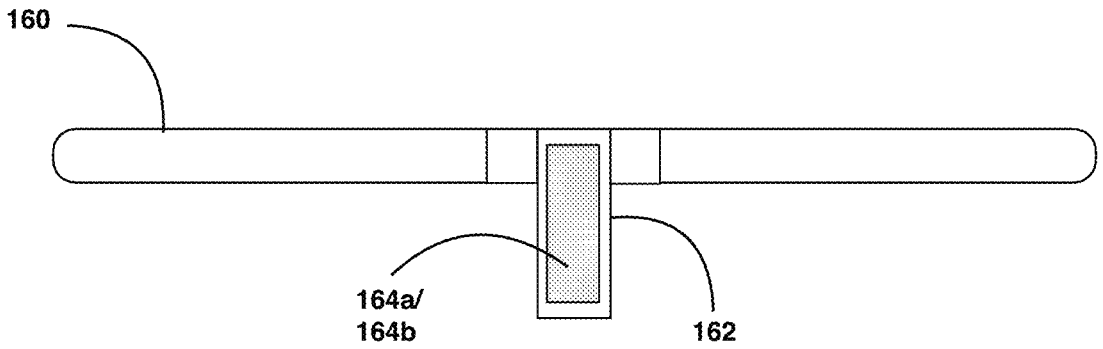
FIG. 8A illustrates a partial cross sectional front view of a detachable tray of the hair extension support apparatus of the disclosure described herein.
Figure 8B:
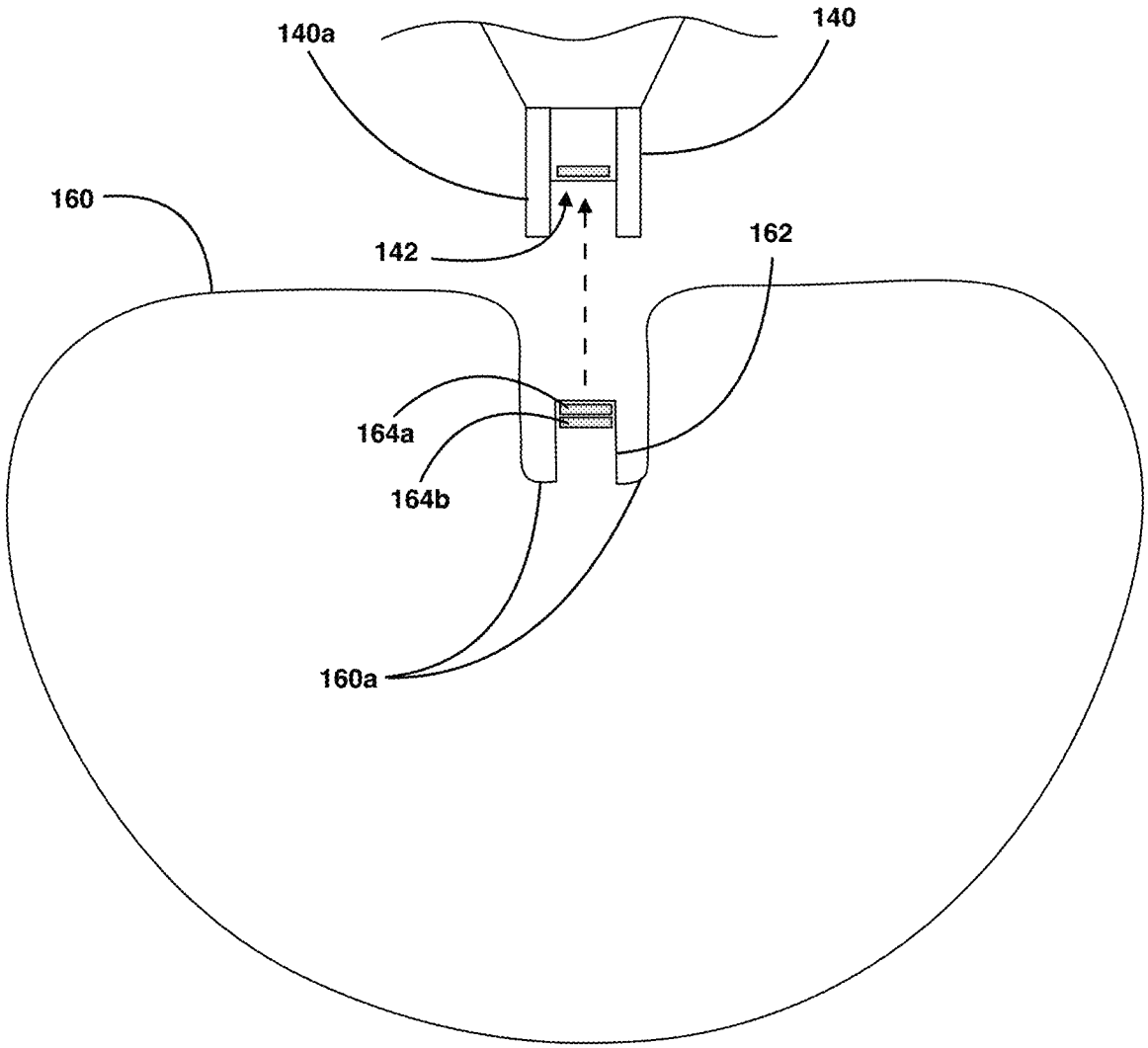
FIG. 8B illustrates a partial cross sectional top view of the neck and tray of the hair extension support apparatus of the disclosure described herein.

FIG. 7B illustrates a partial cross-sectional rear view of the neck region 140 of the hair extension support apparatus. Here, neck 140 can include a pair of tracks 140*a* with a channel or groove disposed therein, wherein the channel can include an elongated metal, ferrous, or magnetized element 142 either secured on the surface of the channel between the pair of tracks or disposed behind the channel or pair of tracks 140*a*. Here, metal or magnetized element piece 142 is configured to couple to another opposing metal or magnetized element piece on cooling tray 160, thereby coupling tray 160 to neck 140 of support apparatus 100, as shown in FIGS. 8A-8B. Still referring to FIG. 7B, neck region 140 or tracks 140*a* may also include plurality of notches, tabs, or stops 144 that allow the user to better position and stop tray 160 on neck 140, or allow a user to better recall a particular position of tray 160 with respect to neck 140.

FIG. 8A illustrates a partial cross sectional front view of tray 160. Here, tray 160 can include an elongated protrusion or L-shaped tab 162 having dual magnetized or magnetic elements 164*a* and 164*b* stacked on top of each other disposed within tab 162 and secured to tray 160. As shown in FIG. 8B, tab 162 is configured to engage the magnetized or metal surface 142 between tracks 140*a* thereby allowing tray 160 to be securely held and supported by neck region 140. In particular, tracks 140*a* are configured to fit within and slide within notches 160*a* thereby stabilizing tray 160 with respect to neck 140, while tab 162 securely engages surface, metal, or magnetized element 142 of neck 140. Here, it is contemplated within the scope of the disclosure described herein that other securement mechanisms may also be used in lieu of components 140*a*, 142, 144, 160*a*, 162, 164*a*, and 164*b*, including but not limited to brackets, adhesives, hook and loop fasteners, rollers, bearings, pulleys, clips, snaps, locks, or other fasteners or sliding mechanisms.

Figure 9A:
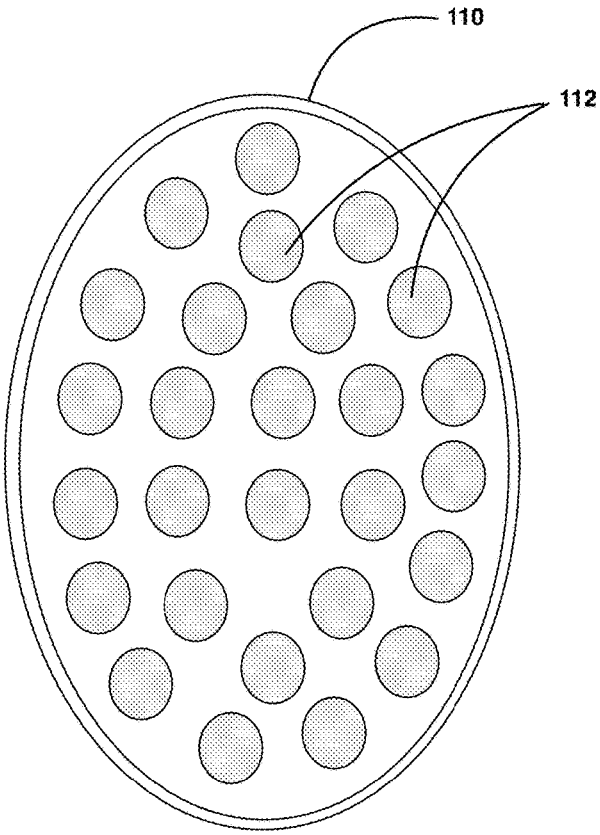
FIG. 9A illustrates a partial cross-sectional interior rear view for one non-limiting embodiment of the face area of the hair extension support apparatus of the disclosure described herein, illustrating multiple magnetic elements.
Figure 9B:
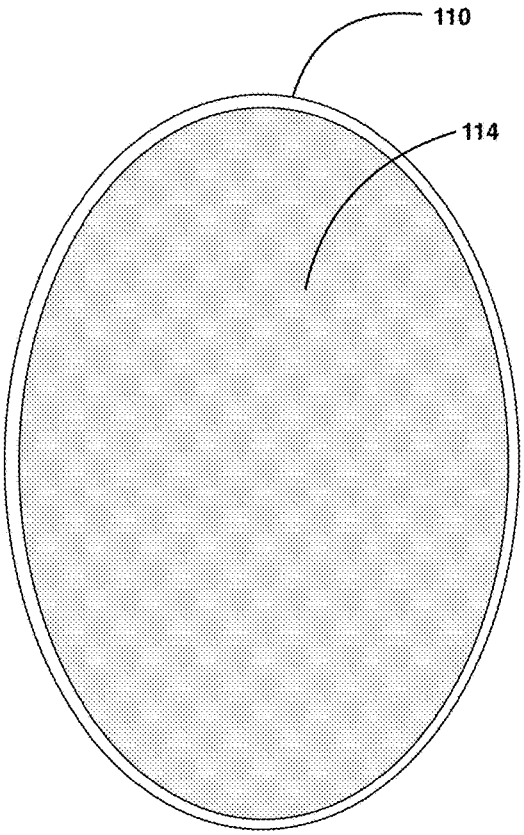
FIG. 9B illustrates a partial cross-sectional interior rear view for another non-limiting embodiment of the face area of the hair extension support apparatus of the disclosure described herein, illustrating a single magnetized element.

FIG. 9A illustrates one embodiment of a magnetized facial region apparatus 100 for holding one or more metal objects or accessories. Here, the interior back region face 110 (i.e. interior of half piece 100*a*) can include a plurality of magnetic elements 112 disposed, dispersed, and secured to the face via one or more adhesives or fasteners. FIG. 9B illustrates another embodiment of a magnetized facial region of apparatus 100 for holding one or more metal objects or accessories. Here, the interior back region face 110 (i.e. interior of half piece 100*a*) can include a single unitary magnetic element 114 secured to the face via one or more adhesives or fasteners. In the alternative, the entire face region 110 of apparatus 100 may also be made of a magnetic or ferrous material.

Figure 10A:
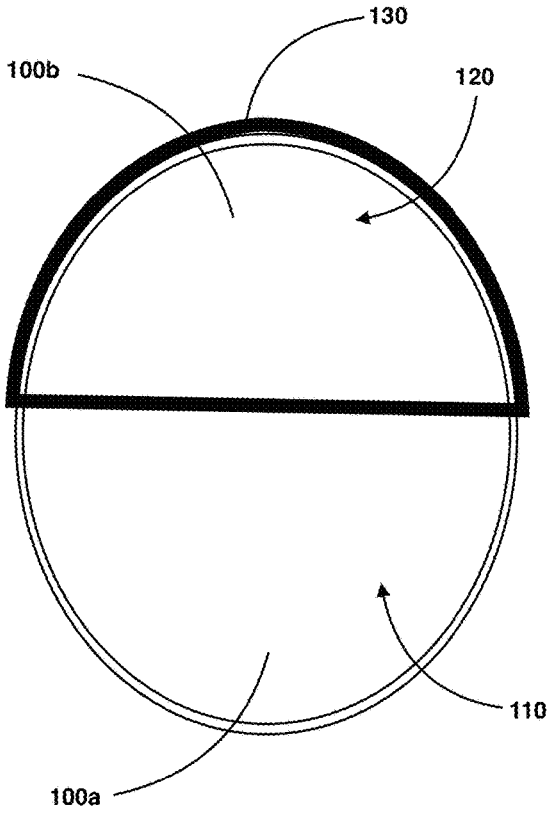
FIG. 10A illustrates partial cross-sectional top view of one non-limiting embodiment of the head region of the hair extension support apparatus of the disclosure described herein.
Figure 10B:
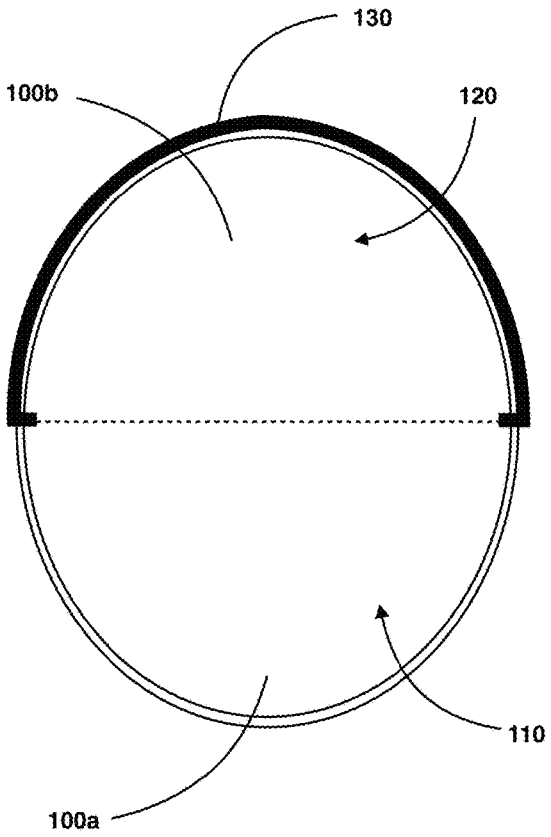
FIG. 10B illustrates partial cross-sectional top view of another non-limiting embodiment of a head region of the hair extension support apparatus of the disclosure described herein.

FIG. 10A illustrates one embodiment for securing elastic bands 130 to the head region of apparatus 100. Specifically, elastic bands may entirely encircle and wrap around the back region 120 of piece 100*b* of apparatus 100. FIG. 10B illustrates another embodiment for securing elastic bands 130 to the head region of apparatus 100. Specifically, elastic bands may also be secured to each side edge of back region 120 of piece 100*b* of apparatus 100.

Having thus described the several embodiments of the present disclosure described herein, those of skill in the art will readily appreciate that other embodiments may be made and used which fall within the scope of the claims attached hereto. Numerous advantages of the invention covered by this document have been set forth in the foregoing description. It will be understood that this disclosure is, in many respects, only illustrative. Changes can be made with respect to various elements described herein without exceeding the scope of the invention. Although the present disclosure described herein has been described in considerable detail with reference to certain preferred versions or embodiments thereof, other versions and embodiments are possible. Therefore, the spirit and scope of the appended claims should not be limited to the description of the embodiments contained herein.

What is claimed is:

1. A hair extension support apparatus, comprising:

a head comprising a front region and a back region;

an elongated neck coupled to the head, wherein the elongated neck further comprises a channel at least partially extending along a rear region of the elongated neck;

one or more elastic straps secured to the back region of the head; and a tray, wherein the tray further comprises a protrusion, wherein the protrusion is received within the channel of the elongated neck, such that the tray is configured to slide relative to the neck along the channel.

2. The hair extension support apparatus of claim 1, wherein the one or more elastic straps are configured to support one or more hair extensions or hair wefts.

3. The hair extension support apparatus of claim 1, wherein the front region of the head comprises one or magnetic elements.

4. The hair extension support apparatus of claim 1, wherein the one or more elastic straps are comprised of a single band.

5. The hair extension support apparatus of claim 1, wherein the one or more elastic straps are comprised of a dual band.

6. The hair extension support apparatus of claim 1, wherein the one or more elastic straps comprise a plurality or apertures or perforations.

7. The hair extension support apparatus of claim 1, wherein the tray is magnetically coupled to the elongated neck.

8. The hair extension support apparatus of claim 1, wherein elongated neck comprises a pair of tracks, wherein the tray is coupled to the channel or the pair of tracks.

9. The hair extension support apparatus of claim 1, further comprising a base, wherein the base is further comprised of one or more suction cups.

10. A hair extension support apparatus, comprising:

a head;

a neck coupled to the head, wherein the neck further comprises a channel having a plurality of tabs or stops extending along its length;

a base coupled to the neck;

a plurality of securement devices secured to the head, adapted to secure one or more hair extensions or hair wefts; and a tray coupled to the neck, wherein the tray further comprises a protruding member, and wherein the protruding member engages at least one of the plurality of tabs or stops of the neck such that the tray is secured horizontally relative to the neck.

11. The hair extension support apparatus of claim 10, wherein the securement devices are comprised of one or more of: dual strap, perforated straps, elastic bands, dual elastic bands, flexible straps, wires, hooks, magnets, fasteners, or adhesives.

12. The hair extension support apparatus of claim 10, wherein the tray comprises a magnetic element.

13. The hair extension support apparatus of claim 10, wherein the tray comprises an elongated tab, and wherein the elongated tab is configured to engage the channel.

14. A hair extension support apparatus, comprising:

a head;

an elongated neck having a curvature along its length, wherein the elongated neck further comprises a first engagement member at least partially extending along a rear region of the elongated neck;

a plurality of elastic bands secured to the head and at least partially extending around a back region of the head; and a tray coupled to the elongated neck, wherein the tray further comprises a second engagement member, whereby the second engagement member couples to the first engagement member and wherein the tray is further configured to slide along the curvature of the elongated neck.

* * * * *